US005802892A

United States Patent [19]

Cohn et al.

[11] Patent Number: 5,802,892

[45] Date of Patent: Sep. 8, 1998

[54] STORAGE SYSTEM INCLUDING MULTIFUNCTION LOCK ASSEMBLY UTILIZING LOCK LATCH MECHANISM AND LOCK LATCH EXTENSION MECHANISM

[75] Inventors: Robert J. Cohn, Dallas; Douglas J. Kaminski, Wilkes-Barre; Robert W. Altonji, Quakertown, all of Pa.

[73] Assignee: Metro Industries, Inc., Reno, Nev.

[21] Appl. No.: 643,434

[22] Filed: May 8, 1996

[51] Int. Cl.[6] ..... E05B 65/44

[52] U.S. Cl. ..... 70/84; 292/269; 312/217

[58] Field of Search ..... 70/77–84; 292/341.15, 292/198, 207, 341.17, 341.18, 268, 269; 312/217–219

[56] References Cited

U.S. PATENT DOCUMENTS

| | | | |
|---|---|---|---|
| 1,183,379 | 5/1916 | Hick | 70/84 |
| 2,448,748 | 9/1948 | Vanderveld | 70/82 |
| 3,003,348 | 10/1961 | Jacobi | 70/84 |
| 3,598,462 | 8/1971 | Kanitz | 70/82 X |
| 3,964,280 | 6/1976 | Kelton | 70/84 |
| 4,131,002 | 12/1978 | Gianelo | 70/84 |
| 4,195,867 | 4/1980 | Baillie | 70/81 X |
| 4,220,364 | 9/1980 | Poe | 292/341.18 |
| 4,230,350 | 10/1980 | Gee et al. | 292/341.15 X |
| 4,776,619 | 10/1988 | Daugherty et al. | 292/207 X |
| 4,955,159 | 9/1990 | Rogers | 292/269 X |
| 5,345,795 | 9/1994 | James et al. | 70/84 |
| 5,407,126 | 4/1995 | Coultas et al. | 292/341.17 X |

FOREIGN PATENT DOCUMENTS

| | | | |
|---|---|---|---|
| 322971 | 7/1920 | Germany | 292/269 |

*Primary Examiner*—Suzanne Dino Barrett

*Attorney, Agent, or Firm*—Fitzpatrick, Cella, Harper & Scinto

[57] ABSTRACT

A storage system including a storage container body, a door, and a lock assembly, the lock assembly including a lock latch mechanism located in a side wall of the storage container body remote from the door, and a striker member located on the door, wherein the lock latch mechanism includes at least one lock catch selectively capable of engaging and securing either one of a storage article resident in the storage container body or the striker member. The lock latch assembly may include a lock latch extension mechanism that includes a shuttle slide including a locking portion engagable with a lock catch of the lock latch mechanism, and a latching portion engagable with the striker member of the lock latch mechanism. The lock latch extension mechanism preferably also includes a shuttle retainer for slidably supporting the shuttle slide between a locking position, where the lock catch of the lock latch mechanism is engagable with the locking portion, and a release position, where the lock catch is not engagable with the locking portion, and where the striker member is engagable with the latching portion when the shuttle slide is in either the locking position or the release position, and is releasable from the latching portion when the shuttle slide is in the release position.

23 Claims, 14 Drawing Sheets

STORAGE SYSTEM INCLUDING MULTIFUNCTION LOCK ASSEMBLY UTILIZING LOCK LATCH MECHANISM AND LOCK LATCH EXTENSION MECHANISM

BACKGROUND OF THE INVENTION

1. Field of the Invention

The present invention relates generally to storage systems including a lock latch mechanism, and more particularly to a storage system including a lock assembly utilizing a lock latch mechanism, a striker bail assembly and a lock latch extension mechanism. The present invention has particular utility in a cabinet system that includes an existing lock latch mechanism located in an interior side wall panel of the cabinet body remote from the face of a cabinet door. However, the lock assembly of the present invention, utilizing a multifunction lock latch mechanism and a lock latch extension mechanism, also may have utility in other storage systems, particularly storage systems including a lock assembly utilizing a remotely located lock latch mechanism.

2. Description of the Related Art

Storage systems including doors or removable protective coverings are known. For example, a conventional cabinet may include a cabinet housing, a plurality of shelves, and a cabinet door or protective cover (hereinafter "door"). It is also known to provide such a system with removable shelves, trays, or slide-out drawers. Such systems provide various advantages, including increased storage capacity and greater accessibility to items stored in the storage system. Such storage systems, however, may suffer a drawback in that these removable shelves and sliding drawers may inadvertently shift to an extended position, e.g., during relocation of the storage system, resulting in loss of items stored therein or damage to the door or external structures located in close proximity thereto.

This drawback conventionally is overcome by providing the storage system with a heavy duty door and a lock mechanism on the door. However, safe handling of such a storage system then requires that the lock mechanism be capable of withstanding the collective weight or force of the plurality of shelves or drawers incident thereon. Accordingly, conventional storage systems of this type may require a heavy duty lock mechanism for locking the cabinet door or protective covering to the housing of the storage system.

It is also known to provide a storage system including a lock latch mechanism located in a remote portion of an interior side wall panel of the storage system. For example, Applicants' assignee, InterMetro, Inc., manufactures and sells a versatile storage system which utilizes such a remote lock latch mechanism under the Registered Trademark "StarSys". The StarSys system comprises specially designed corner posts which can be configured with internally and externally mounted accessory panels and other structures to form numerous alternative open or closed storage systems, including cabinets, shelving systems, drawer systems and the like. Numerous variable configurations and advantageous features of the StarSys system are disclosed in a number of pending patent application filed by Applicants' assignee, including U.S. patent application Ser. Nos. 08/426,658; 08/426,266; 08/426,670; 08/426,669; 08/426,195; 08/426,265; and 08/426,674, all filed Apr. 21, 1995.

Referring to FIG. 9 of the drawings, a storage system having a cabinet configuration incorporating the StarSys system is schematically illustrated. As shown in FIG. 9, a storage system 10 generally includes a cabinet body 12 and a cabinet door 14. The cabinet body 12 includes a plurality of corner support posts 16 (e.g., four) which support a plurality of side wall panels 18. For simplicity of discussion, only one corner post 16 and one side panel 18 are illustrated in FIG. 9. Also illustrated in phantom are a plurality of storage articles (e.g., shelves, trays or drawers) 20, and a lock bar 22.

As shown in FIG. 9, the side wall panel 18 includes a plurality of alternating rails 24 and slides 26 arranged in a corrugated configuration. The rails 24 extend inwardly from the side wall panel 18, with adjacent rails 24 thereby forming respective slides 26 therebetween. In FIG. 9, the rails 24 and slides 26 are arranged in a horizontal, parallel arrangement for slidably receiving one or more storage articles 20. However, the rails 24 and slides 26 may be arranged in alternative configurations, as is known in the art.

The lock bar 22 is provided in the side wall panel 18 at a location remote from the cabinet door 14, and is arranged to extend vertically within the side wall panel 18. For example, the lock bar 22 may be located at a distance of about 2 to 4 inches, preferably about 3 inches from the opening of the cabinet body 12. The lock bar 22 is slidably supported within the cabinet body 12 for movement in a vertical direction, and may be driven up and down in the vertical direction in a controlled manner by an actuator 28 (e.g., a manually operated lever, cam mechanism, electric motor or the like; also shown in phantom). A plurality of lock catches 30 (shown in phantom) are fixed to the lock bar 22 and supported thereon for vertical movement therewith. The lock catches 30 may be any conventional type of catch, e.g., pawls, claws, hooks or the like. The plurality of lock catches 30 are provided at predetermined spaced locations along the vertical length of the lock bar 22 corresponding to the location of the rails 24 and the slides 26. Each lock catch 30 protrudes through a respective one of plural cut-out portions 32 (also shown in phantom) in the side wall panel 18. Each storage article 20 is provided with a detent (not shown) or end surface engagable with a lock catch 30 when stored in a closed configuration. In this manner, each of a plurality of storage articles 20 resident in respective slides 26 of the cabinet body 12 may be simultaneously locked into place or released by controlled vertical movement of the lock bar 22.

This remote located lock latch mechanism provides a significant advantage, in that it may reduce or eliminate the need for a heavy duty lock mechanism for the cabinet door or protective covering because it prevents the shelves or drawers from shifting and striking the door or cover. However, it is still necessary to latch and/or lock the cabinet door or protective cover to the cabinet housing. Therefore, it is desirable to provide a storage system including a single lock mechanism that is capable of both securing a plurality of storage articles in the storage system and locking and latching the cabinet door or protective cover.

SUMMARY OF THE INVENTION

It is therefore an object of the present invention to provide a storage system including a storage container, a door or protective cover, and a lock assembly capable of both engaging and securing a storage article resident in the storage container and the door or protective cover.

It is another object of the present invention to provide a lock latch mechanism and a lock extension mechanism for use in an existing lock latch assembly, wherein a lock catch is located in a side wall panel of a cabinet body remote from the cabinet door.

It is another object of the present invention to provide a lock latch extension mechanism which is simple in design and easy to fabricate.

It is another object of the present invention to provide such a lock latch extension mechanism which is easy to install, and readily changeable in location.

It is another object of the present invention to provide a lock latch extension mechanism that is corrosion resistant and safe for handling food products, health products, perishables and the like.

It is a yet another object of the present invention to provide a lock latch extension mechanism which is easily adaptable to existing storage systems.

These and other objects and advantages are achieved by the storage system and lock latch mechanism of the present invention, including a lock latch extension mechanism of the present invention.

In one aspect, the present invention relates to a storage system including a storage container body, a door, and a lock assembly, the lock assembly including a lock latch mechanism located in a side wall of the storage container body remote from the door, and a striker member located on the door, wherein the lock latch mechanism includes at least one lock catch selectively capable of engaging and securing either one of an article resident in the storage container body or the striker member.

In another aspect, the lock latch mechanism includes a lock latch extension mechanism of the present invention that comprises a shuttle slide including a locking portion engagable with a lock catch of the lock latch mechanism, and a latching portion engagable with the striker member of the lock latch mechanism. The lock latch extension mechanism preferably also includes a shuttle retainer for slidably supporting the shuttle slide between a locking position, where the lock catch of the lock latch mechanism is engagable with the locking portion, and a release position, where the lock catch is not engagable with the locking portion, and where the striker member is engagable with the latching portion when the shuttle slide is in either the locking position or the release position, and is releasable from the latching portion when the shuttle slide is in the release position.

In another aspect, the lock latch extension mechanism comprises a shuttle retainer, including a slide channel, and the shuttle slide is slidably supported in the slide channel of the shuttle retainer between the locking position and the release position. The shuttle retainer includes in side profile a static ramp located at a distal end of the shuttle retainer for camming a striker member incident thereon to a step height, and a central cut away portion for receiving a lock catch of the lock latch mechanism. The shuttle slide includes a locking portion (detent), engagable with the lock catch to lock the shuttle slide in the locking position, and a latching portion located at a distal end of the shuttle slide and cooperable with the static ramp for selectively engaging (capturing) and releasing the striker member. In one embodiment, the shuttle retainer includes first and second side panels forming the slide channel, the cut away portion and the static ramp.

In another aspect, the shuttle retainer includes at least one slide restraint, and the shuttle slide includes at least one guide portion extending in a direction of movement of the shuttle slide for receiving a respective slide restraint of the shuttle retainer, whereby the shuttle slide is restrained or limited in sliding movement at the locking position and the release position. In a preferred embodiment, each guide portion is an extended slot provided with at least one stop portion at a proximal end or a distal end thereof, and engagable with a respective slide restraint in the locking position, the release position, or both, thereby limiting the movement of the shuttle slide.

In another aspect, the latching portion of the shuttle slide includes a ramp portion, a step portion, and means for receiving and capturing a striker member when the shuttle slide is in the locking position (e.g., a latch slot or latch detent), thereby to lock and latch the lock assembly. The static ramp of the shuttle retainer is triangular in side profile, and the ramp portion of the shuttle slide has an inclined ramp complementary in profile to the static ramp and extending from a distal end of the shuttle slide to the step portion. The latching means (slot or detent) is located on a proximal side of the step portion relative to the inclined ramp of the shuttle slide, such that, when the shuttle slide is in the locking position, the latching portion of the shuttle slide is located on a proximal side of the apex of the triangular static ramp in an open configuration for capturing the striker member, and the lock detent of the shuttle slide is aligned with the cut away portion of the shuttle retainer for capturing the lock catch, and when the shuttle slide is in the release position, the latching means of the shuttle slide is located substantially coincident with the apex of the triangular static ramp in a closed configuration for releasing the striker member.

These and other objects, advantages and features of the present invention readily will be understood and appreciated more fully when viewed in conjunction with the following detailed description of the preferred embodiments and the corresponding drawings.

DETAILED DESCRIPTION OF THE PREFERRED EMBODIMENTS

Figure 7:
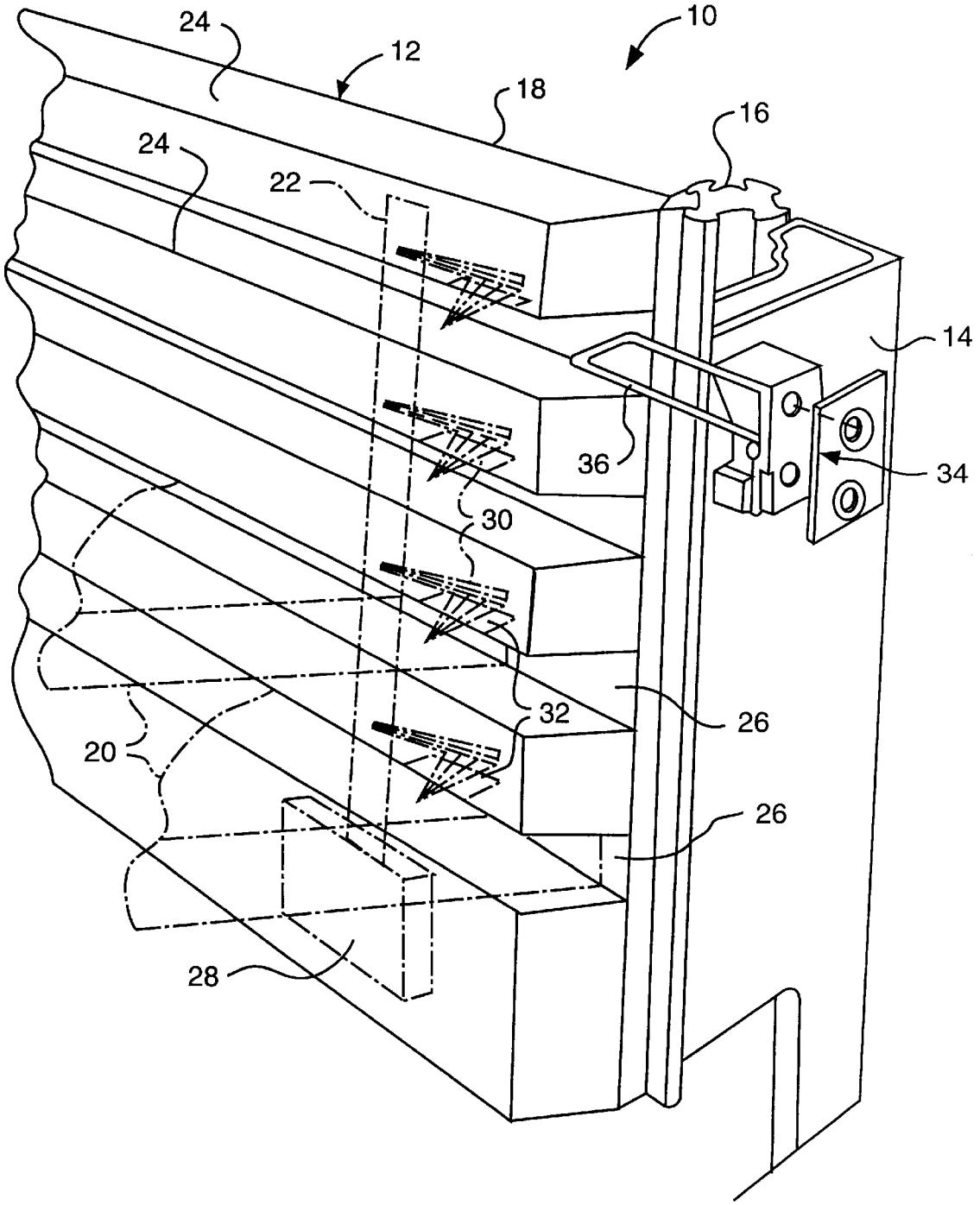
FIG. 7 illustrates a cabinet system of the present invention including a lock latch mechanism located in a side wall panel of the cabinet remote from the cabinet door and an extended striker bail assembly.
Figure 8A:
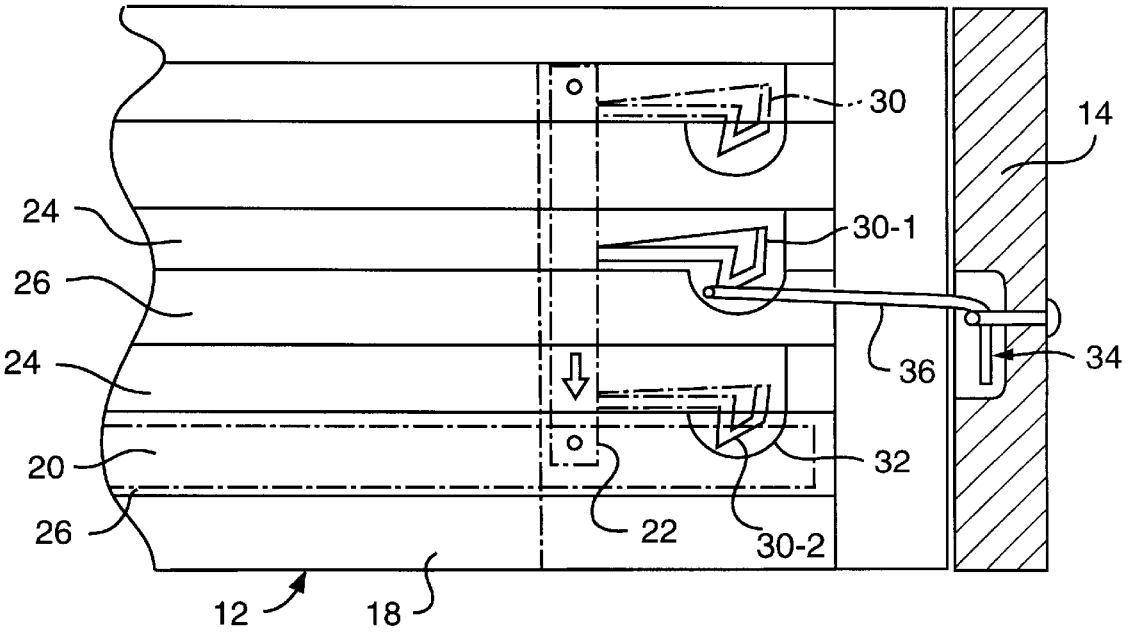
FIGS. 8(*a*), 8(*b*) and 8(*c*) illustrate a general operation sequence for the latch lock and striker bail assembly of FIG. 7 wherein FIG. 8(*a*) illustrates a lock bar and lock catch in a default/locked position, FIG. 8(*b*) illustrates the lock bar and lock catch in an unlocked or release position, and FIG. 8(*c*) illustrates the lock bar and lock catch in an alternative locking operation.
Figure 8B:
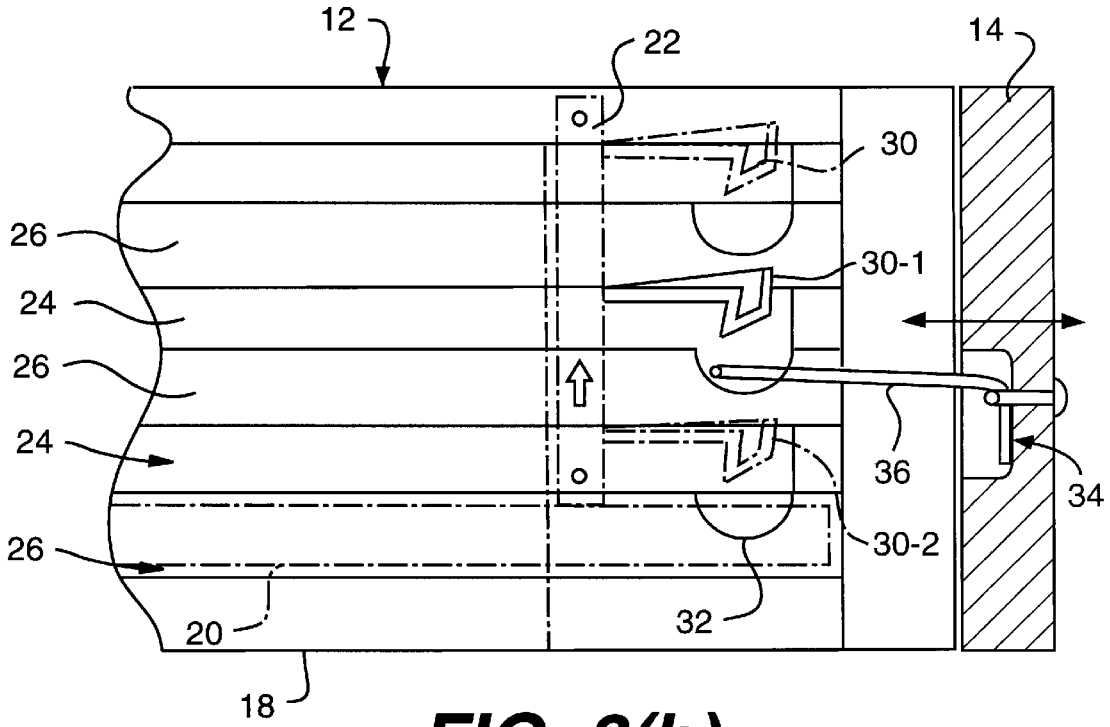
Figure 8C:
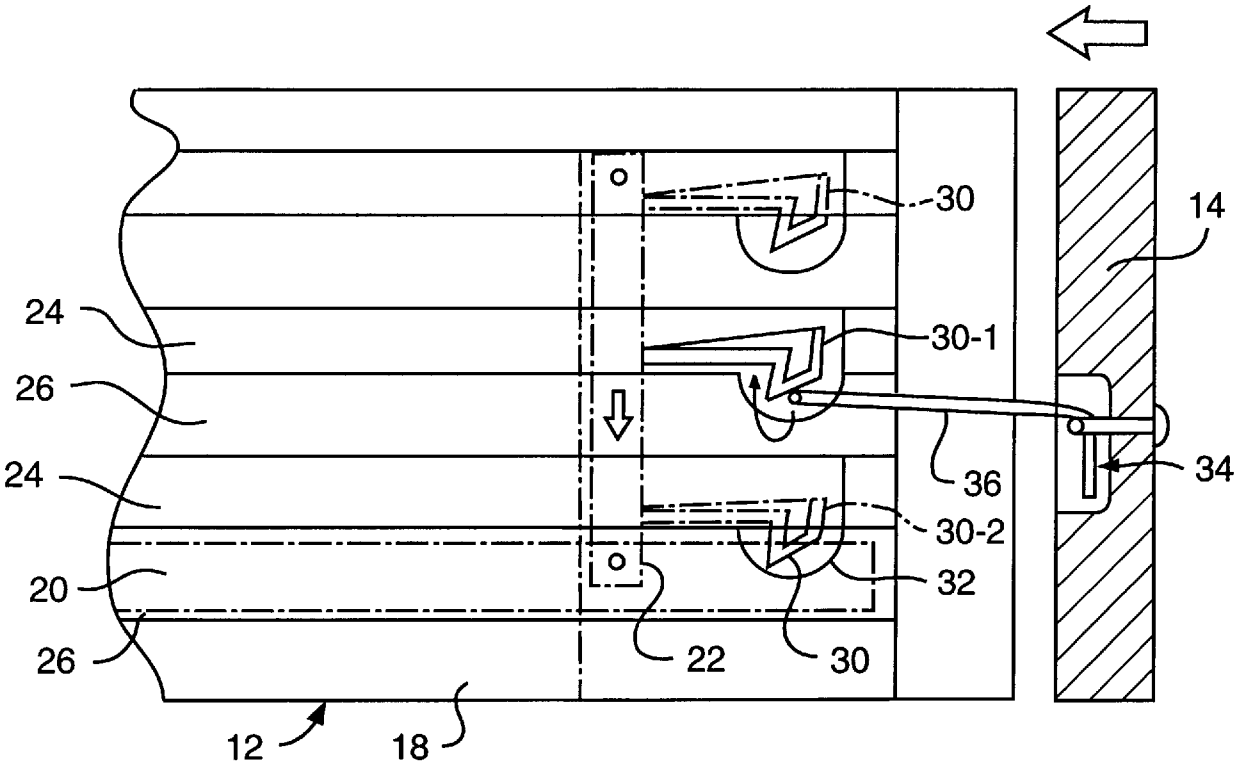
Figure 9:
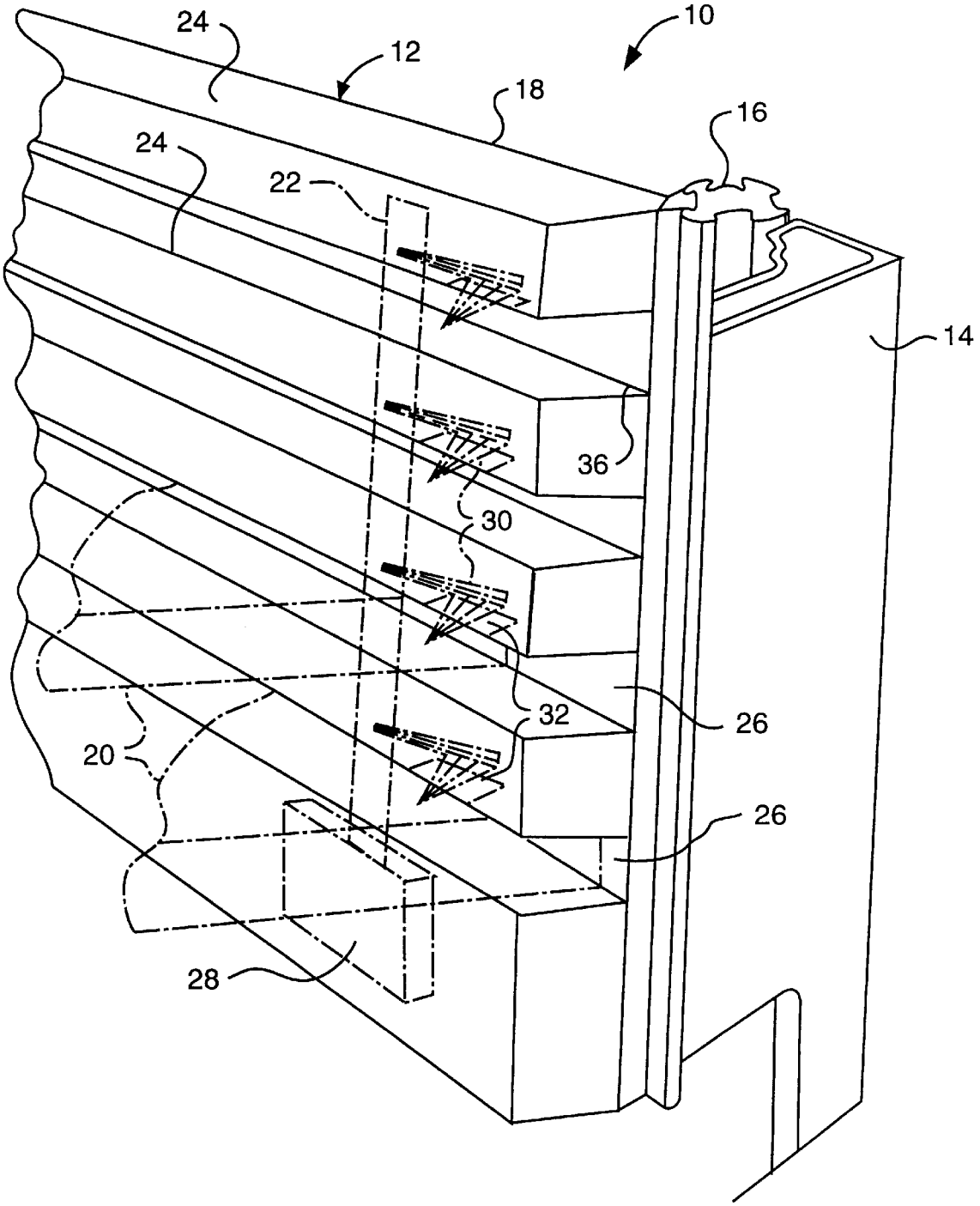
FIG. 9 illustrates a known storage system including a storage container and a lock latch mechanism located in a side wall panel of the storage container for securing a plurality of articles in the container.

Referring now to the drawings, wherein like reference numerals designate like or similar features throughout the various drawings, FIGS. 7, 8(*a*), 8(*b*) and 8(*c*) illustrate a storage system and lock assembly of the present invention. The storage system of the present embodiment implements the above-described StarSys system of FIG. 9, and comprises a lock assembly substantially similar to the lock assembly of FIG. 9. Accordingly, a detailed description of the various elements will not be repeated herein but incorporated by reference.

As shown in FIGS. 7, the storage system 10 generally includes a cabinet body 12, a cabinet door 14, corner support posts 16, side wall panels 18, and storage articles 20. The cabinet door 14 is closed and locked using a lock mechanism comprising a lock latch and striker bail assembly.

As shown in FIGS. 7, 8(*a*), 8(*b*) and 8(*c*), the lock assembly generally includes a lock latch mechanism located in a side wall panel 18 of the cabinet body 12 remote from the cabinet door 14, and a striker bail assembly 34 located on the cabinet door 14. The striker bail assembly 34 includes a striker bail (e.g., a wire hoop, ring, U-shaped bail or the like) 36 fixed on the cabinet door 14 at a predetermined vertical height corresponding to the vertical height of a slide 26 of the cabinet body 12. It will be appreciated that the vertical height of the striker bail 36 thus also will correspond to the vertical height of one of the plurality of lock catches 30. As noted above, the lock bar 22 is slidable in the vertical direction, and may be selectively driven up and down in the vertical direction in a controlled manner by actuator 28.

Referring to FIG. 8(*a*), the lock bar 22 and lock catch 30 may by lowered to a default/locked position, as indicated by the arrow, where one lock catch 30-1 is engagable with the striker bail 36 to lock the cabinet door 14 in a closed position, and another lock catch 30-2 is engagable with a storage article 20 to secure the storage article 20 in the cabinet body 12.

Referring to FIG. 8(*b*), the lock bar 22 and lock catch 30 may be lifted to an unlocked or release position, as indicated by the arrow, where the striker bail 16 is released from the lock catch 30-1 to permit the cabinet door 14 to be opened, and the storage article 20 is released from lock catch 30-2. Of course, this process may be reversed to close and lock the cabinet door 14. In this manner, the same latch lock and striker bail assembly elements may be used to both latch and lock the cabinet door 14.

FIG. 8(*c*) illustrates an alternative locking operation, in which the lock bar 22 and lock catches 30 are lowered to the default/locked position when the cabinet door 14 is still open. When the cabinet door 14 is closed in this configuration, the striker bail 36 strikes an inclined face of the lock catch 30-1, and is cammed relative to the lock catch 30-1 down and around the barbed end of the lock catch 30-1, as shown by the arrow, thereby to engage it. This camming action preferably is facilitated by providing the lock catches 30 and the striker bail 36 with inherent spring bias (flexing) characteristics. This may be achieved, e.g., by selecting materials having an inherent spring bias characteristic, or by providing a cantilevered structure having a spring bias characteristic, or both.

In this manner, it will be appreciated that the striker bail 36 selectively may be mounted on the cabinet door 14 at a height that it is insertable within any one slide 26 of the side wall panel 18 to engage a lock catch 30 at a location remote from the cabinet door 14, and this lock catch/striker bail. mechanism will be substantially enclosed within and shielded by the adjacent rails 24 and slide 26 of the side wall panel 18.

The above-described storage system (cabinet) implementing the StarSys system provides numerous advantageous features. For example, the storage system is readily adaptable to numerous types of storage articles 20 because the storage articles 20 need only be insertable within a slide 26 located between two adjacent rails 24 of the side wall panels 18 of the cabinet body 12. Also, since the lock bar 22 and lock catches 30 are located in the side wall panel 18 of the cabinet body 12, remote from the cabinet door 14, the lock catches 30 are unlikely to be damaged or broken during normal use because they are substantially shielded by the corrugated structure of the rails 24 and slides 26 of the storage system. Also, the storage articles 20 may be independently locked or secured in place, and are not likely to be inadvertently unlatched.

In this regard, however, in some applications, it may be preferable to provide a latching mechanism for the cabinet door at a location less remote from the cabinet door. Such an arrangement would minimize the amount of projection (length) of the striker bail and/or the lock catch. Among other advantages, shortening the length of the striker bail would reduce the risk of undesirably catching the striker bail on various external items when the cabinet door is opened and closed, which may cause damage to the striker bail, the external object (e.g., clothing), or both.

FIGS. 1 to 4 schematically illustrate a second embodiment of the present invention, comprising a storage system including a lock latch extension mechanism of the present invention. In the embodiment of FIGS. 1 to 4, the storage system-also is a cabinet system implementing the StarSys system and the configuration described above, modified to include a lock latch extension mechanism of the present invention. Accordingly, a detailed description of the various elements will be omitted, and only the various modifications will be describe below.

Figure 1:
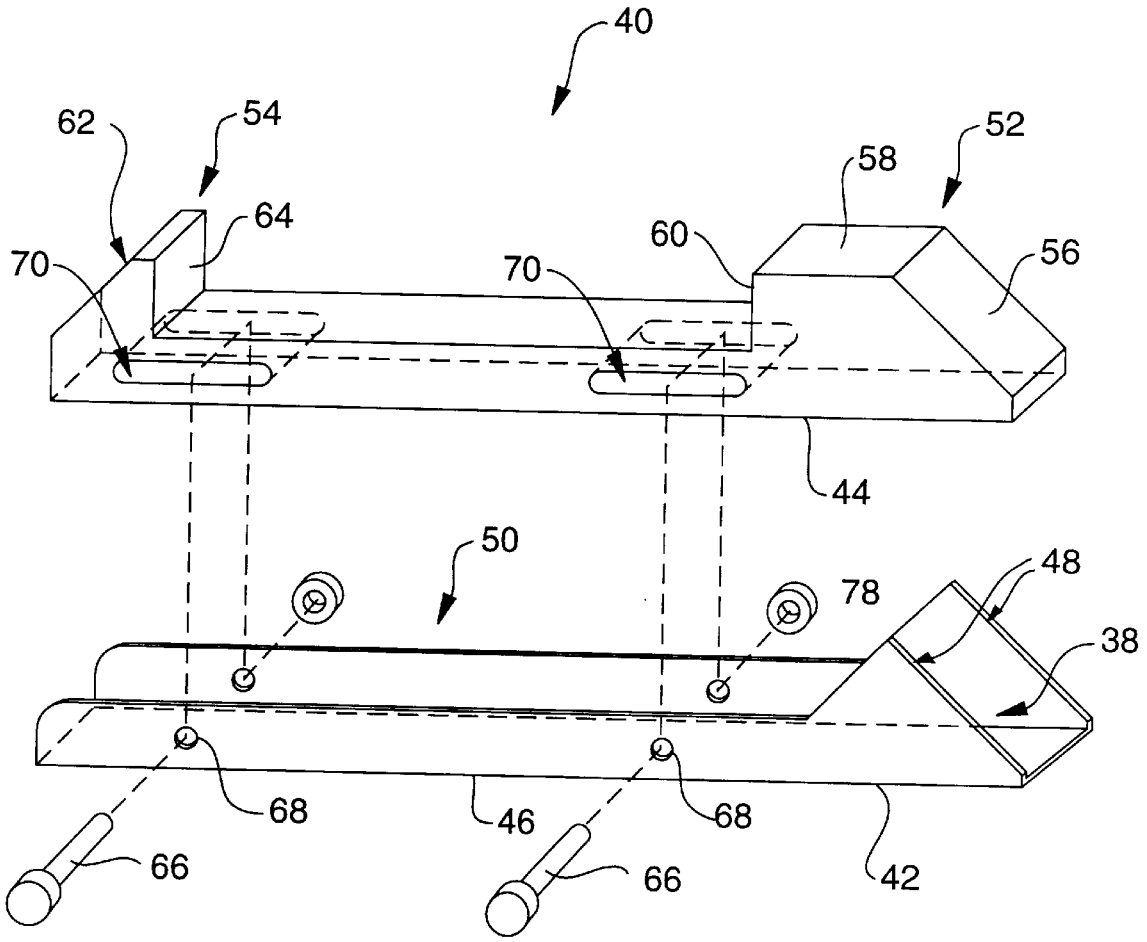
FIG. 1 is an exploded view of a lock latch extension mechanism of the present invention.

FIG. 1 is an exploded view of a preferred embodiment of a lock latch extension mechanism 40 of the present invention. In this embodiment, the lock latch extension mechanism 40 generally includes a shuttle retainer 42 and a shuttle slide 44.

As described in greater detail below, a primary function of the shuttle retainer 42 is to slidably support the shuttle slide 44 for movement between a locking position and a release position. Thus, in its simplest form, the shuttle retainer 42 has a generally U-shaped body 46 forming a slide channel 38 for slidably receiving and supporting the shuttle slide 44. The shuttle retainer generally includes a static ramp 48 located at its distal end, and a cut-away portion 50 extending proximally therefrom. As discussed below in greater detail, the function of the static ramp 48 is to provide a camming operation on a striker bail 36 incident on the lock latch extension mechanism 40, and the function of the cut-away portion 50 is to allow access to a lock catch 30 for engaging and locking the shuttle slide 42 in the locked position and for locking the striker bail 36 in a latched position.

The shuttle retainer 42 may be made of any material suitable for its intended environment. For example, in the preferred embodiment, the shuttle retainer is made of a cut and bent (angled) stainless steel sheet. This construction provides a high strength component that is inexpensive and easy to fabricate, and is corrosion resistant. Of course, other metals and materials such as plastics may provide advantages in particular applications.

The shuttle slide 44 generally includes a latching portion 52 and a locking portion 54. The latching portion 52 is located at the distal end of the shuttle slide 44 and, in the preferred embodiment, includes a striker ramp portion 56, a step portion 58, and a striker detent 60. As discussed in greater detail below, in the present embodiment, the striker detent 60 provides means for receiving and capturing a striker bail 36. The locking portion 54 is located at the proximal end of the shuttle slide 44, and includes a detent ramp 62 and a lock detent 64.

The shuttle slide 44 also may be made of any material suitable for its intended environment. For example, in the preferred embodiment, the shuttle slide 44 is made of molded plastic, such as nylon or the like. This construction provides a high strength component that is inexpensive, easy to fabricate, and corrosion resistant. Also, when used with the stainless steel shuttle retainer 42 described above, it provides an inherent lubricating effect. Of course, other materials may provide advantages in particular applications.

Figure 2:
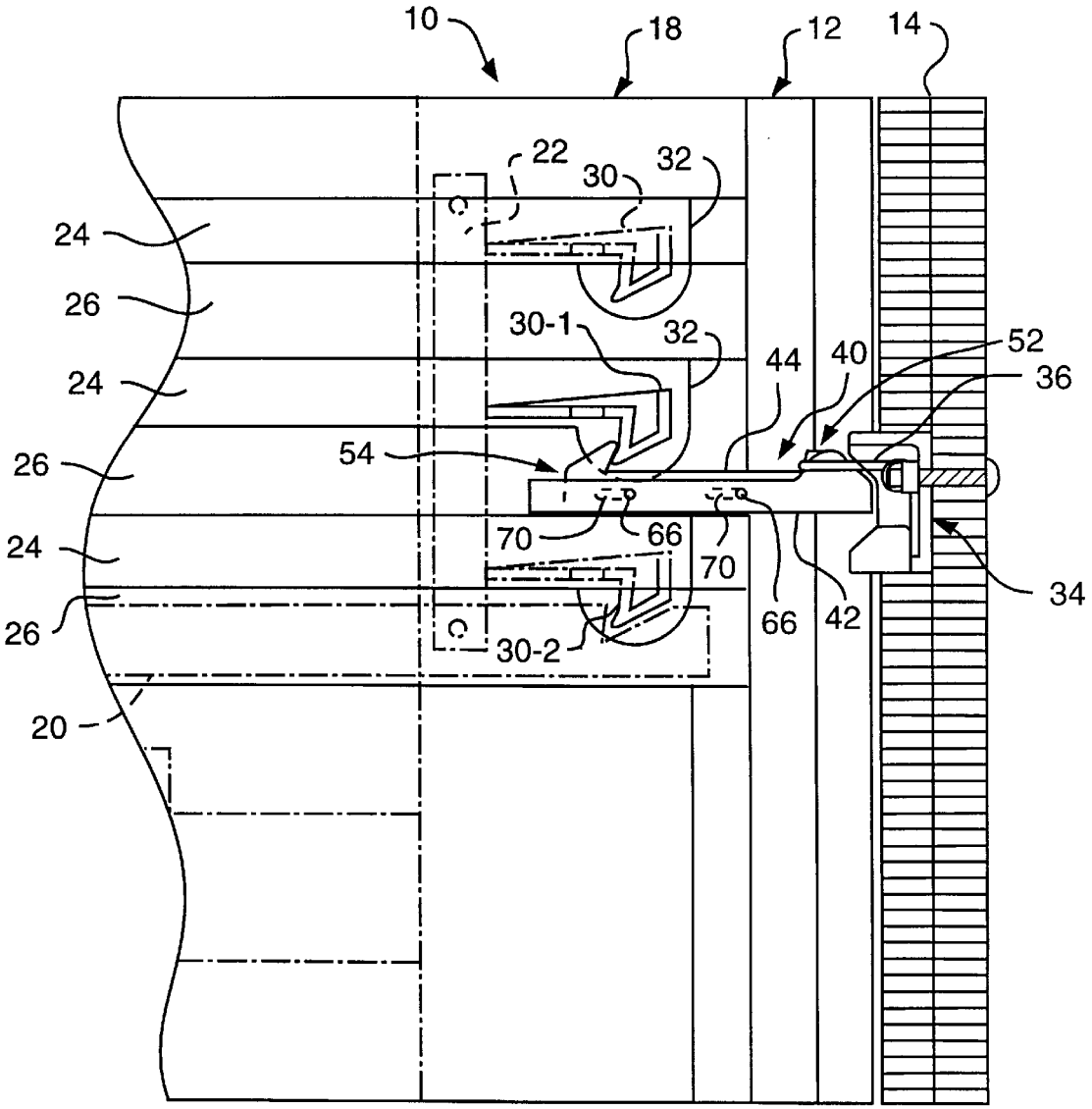
FIG. 2 schematically illustrates a cabinet assembly including a lock assembly utilizing the lock latch extension mechanism of FIG. 1.

FIG. 2 schematically illustrates a preferred embodiment of a storage system utilizing a StarSys configuration and the lock latch extension mechanism 40 of FIG. 1. In FIG. 2, a storage system 10 schematically is shown in side profile, and generally includes a cabinet body 12 including a side wall panel 18 having a plurality of rails 24 and slides 26 formed therein, a cabinet door 14 including a striker bail assembly 34 and striker bail 36, a lock bar 22 located in the side wall panel 18 of the cabinet body 12 and including a plurality of lock catches 30 arranged for controlled vertical movement, at least one storage article 20 slidably supportable in the arrangement of rails 24 and slides 26, and a lock latch extension mechanism 40.

Figure 3:
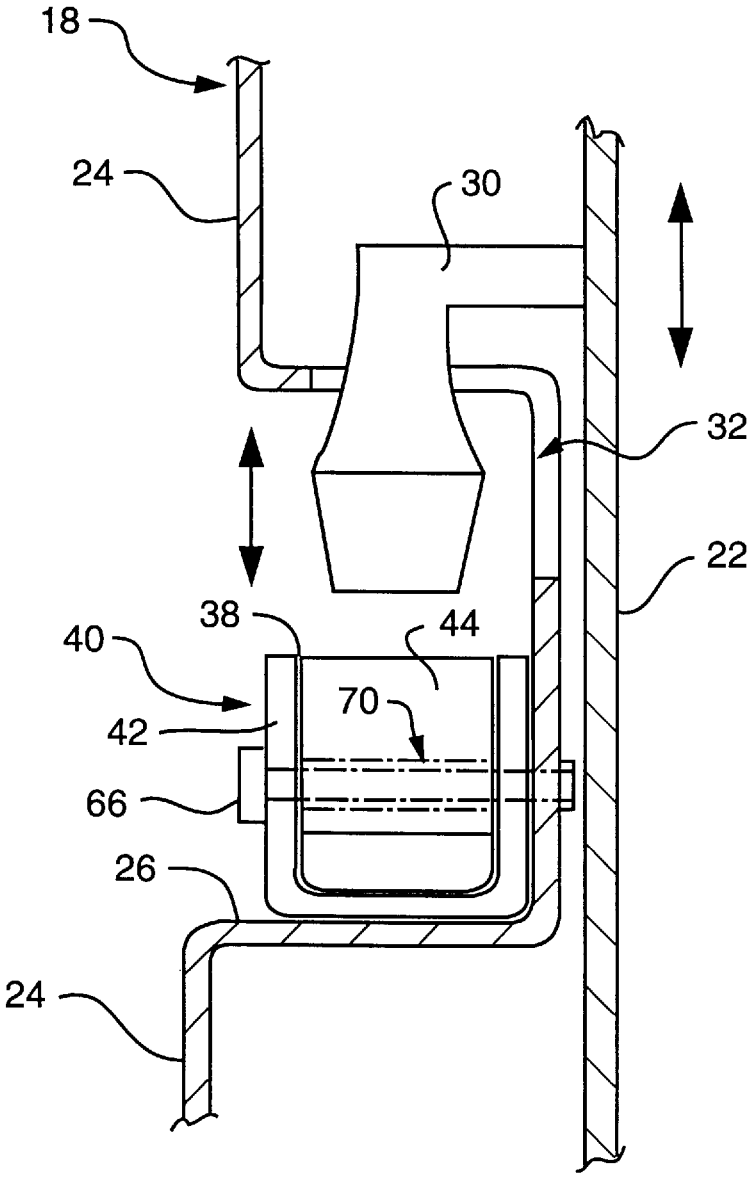
FIG. 3 is an enlarged front view, in partial cross-section, of the lock latch extension mechanism illustrated in FIG. 2.
Figure 4A:
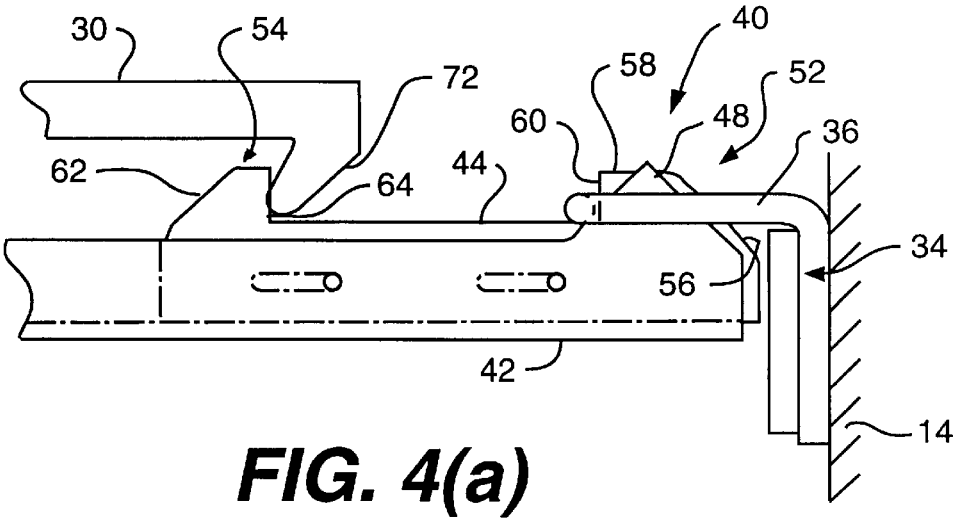
FIGS. 4(*a*) to 4(*i*) illustrate a general operation sequence for a lock assembly including the lock latch extension mechanism illustrated in FIG. 1, wherein FIGS. 4(*a*) to 4(*d*) illustrate an opening sequence, FIGS. 4(*e*) to 4(*g*) and 4(*a*) illustrate a closing sequence, and FIGS. 4(*h*) to 4(j) and 4(*a*) illustrate an alternative closing sequence.
Figure 4B:
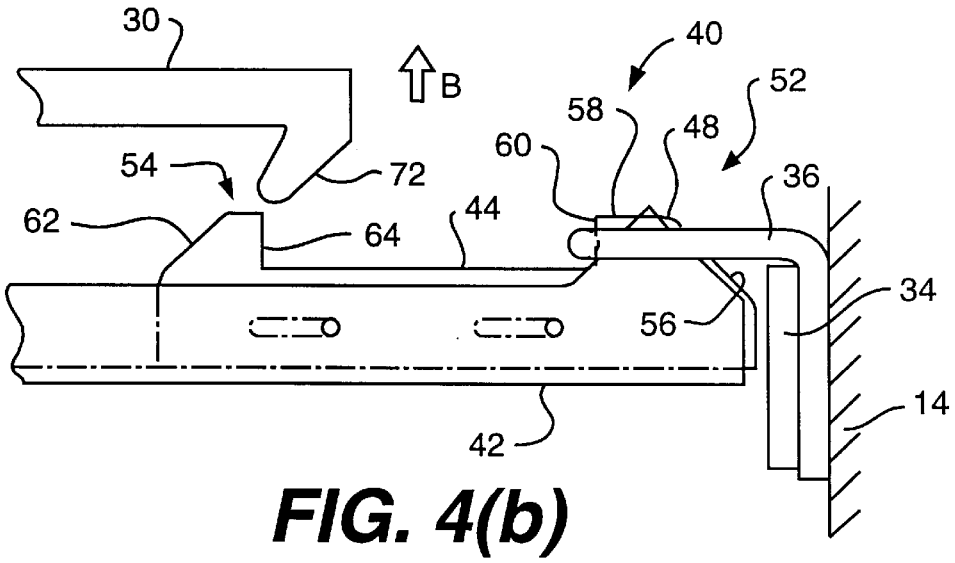
Figure 4C:
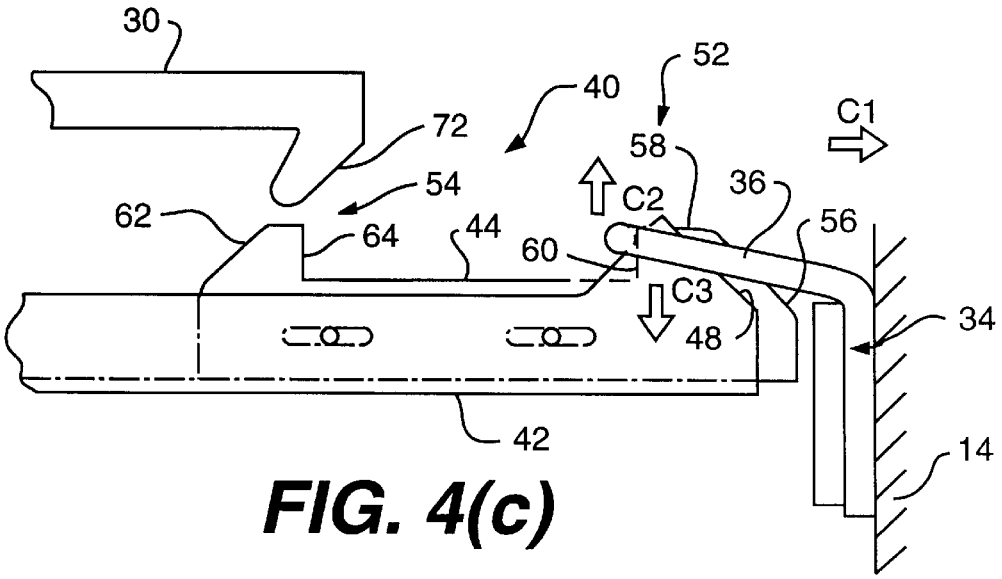
Figure 4D:
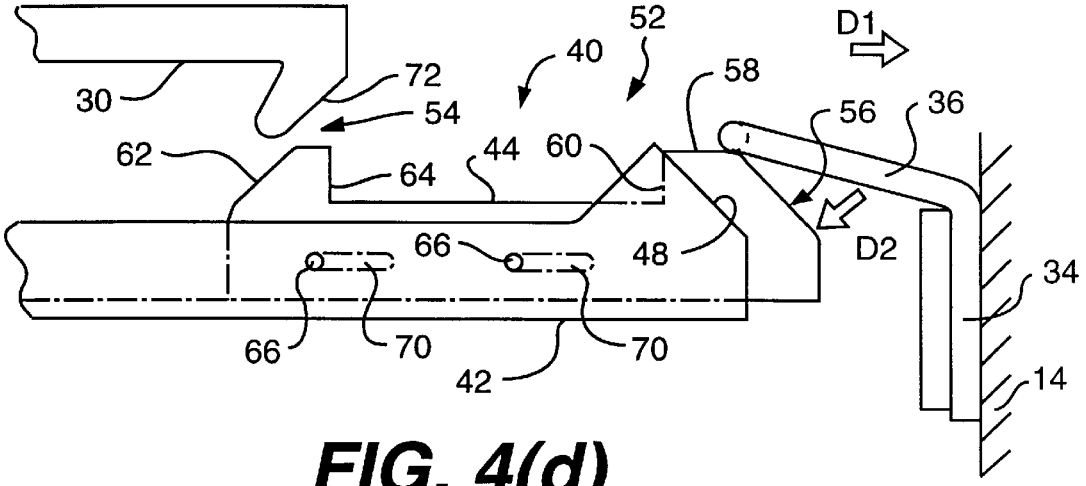
Figure 4E:
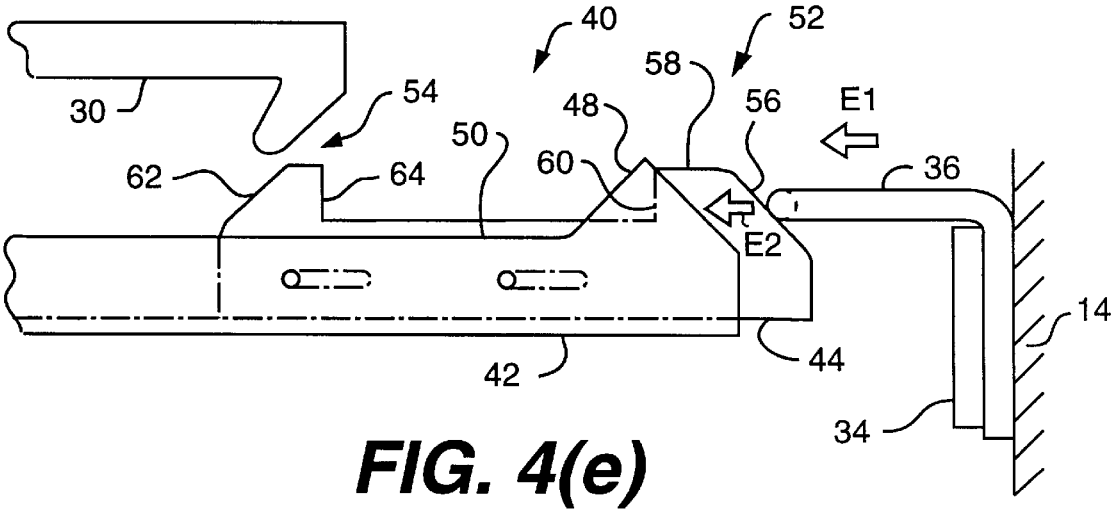
Figure 4F:
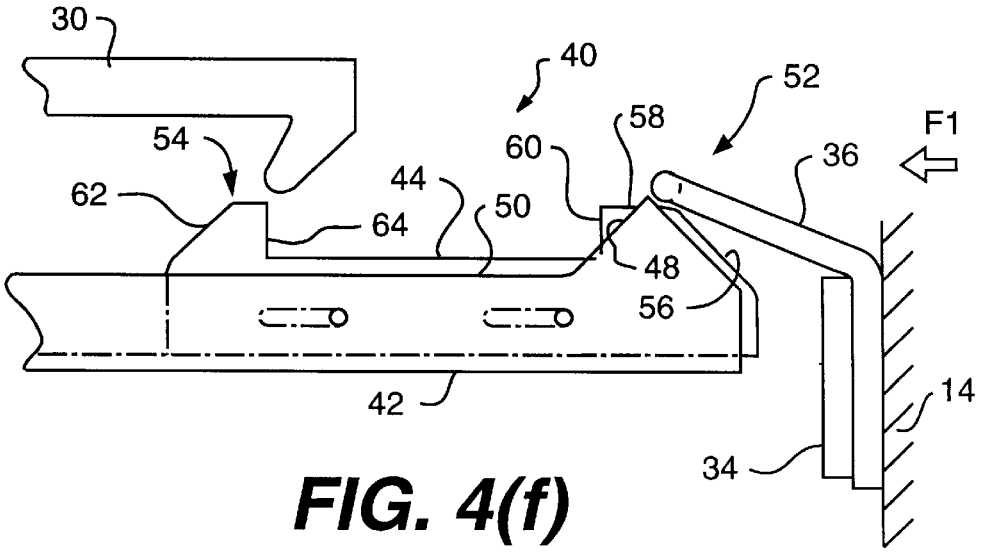
Figure 4G:
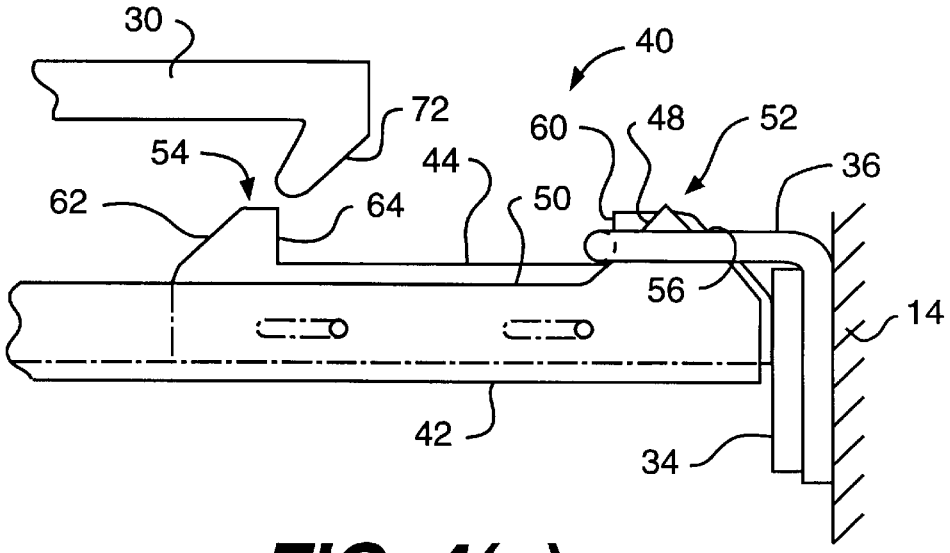
Figure 4H:
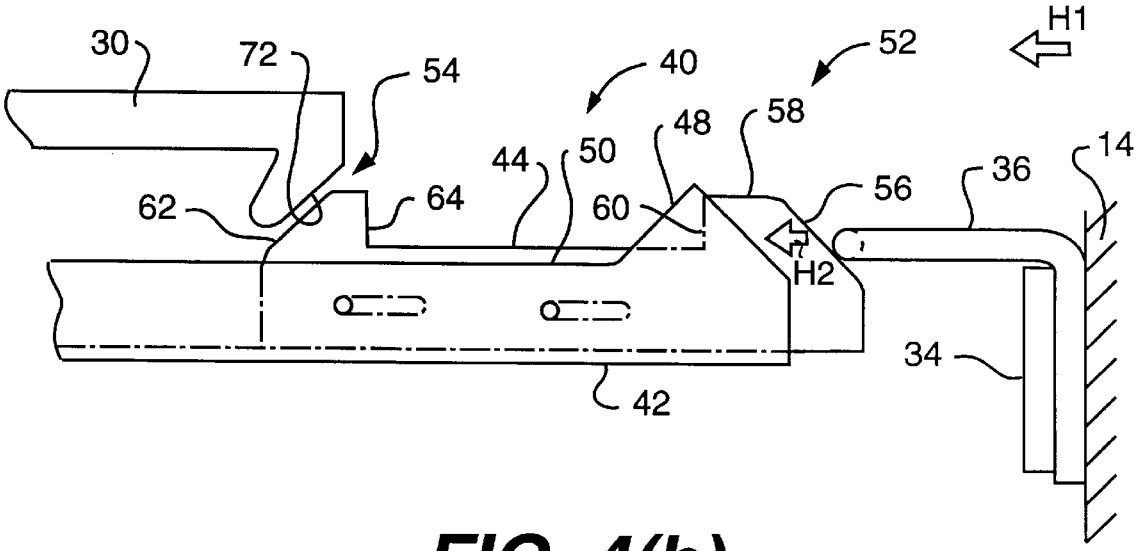
Figure 4I:
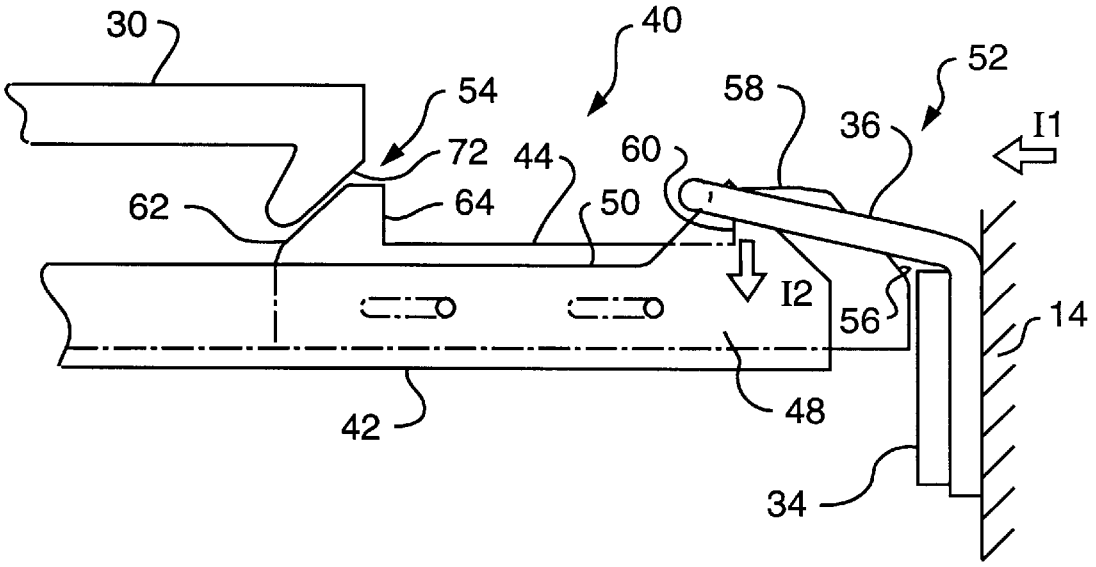
Figure 4J:
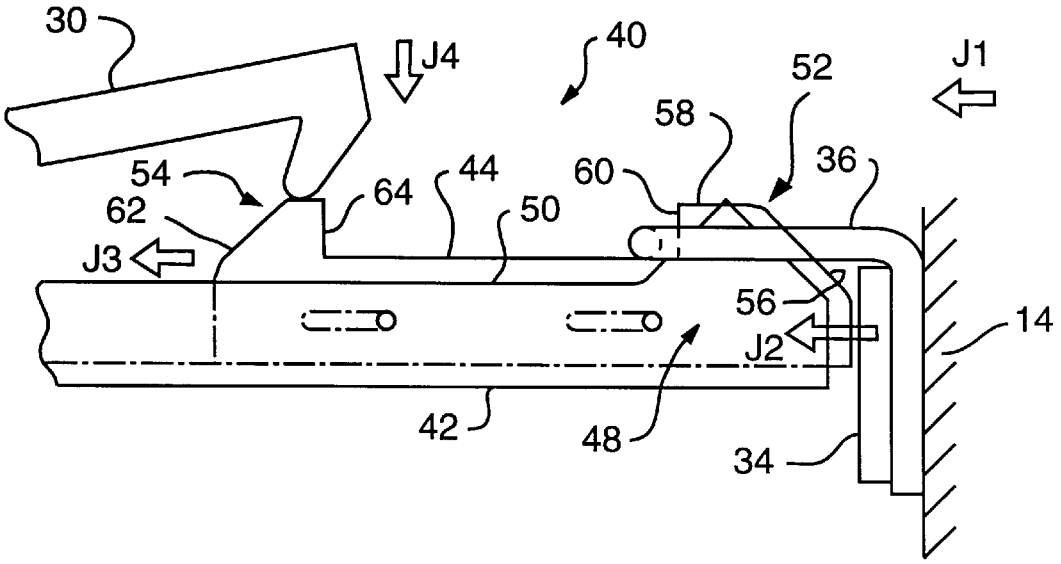

Referring now to FIGS. 2 and 3, the lock latch extension mechanism 40 is mounted to the side wall panel 18, within a slide 26 thereof, such that the locking portion 54 is located adjacent an existing lock catch 30, and the latching portion 52 is located proximate the opening of the cabinet body 12 and engagable with a striker bail 36 of the cabinet door 14. Referring to FIGS. 1 and 3, the lock latch extension mechanism 40 may be fixed to the side wall panel 18 using conventional fasteners (such as screws, bolts, rivets and the like) 66. In the present embodiment, the shuttle retainer 42 is provided with fastener holes 68, and the shuttle slide 44 is provided with elongated slots 70 for accommodating the fasteners 66. As best shown in FIGS. 1 and 2, the slots 70 in the shuttle slide 44 are elongated in a direction of movement of shuttle slide 44. As discussed in greater detail below, in the preferred embodiment, each fastener 66 forms a slide restraint cooperable with an elongated slot 70; the location and length of the elongated slots 70 preferably are selected to correspond to the locking position and the release position of the shuttle slide 44, with each elongated slot 70 forming a guide portion having a stop portion at each end thereof. In this manner, each elongated slot 70 forms guide means for guiding a sliding movement of the shuttle slide between the locking position and the release position.

Referring again to FIG. 3, the overall height and width of the lock latch extension mechanism 40 is selected to correspond to the height and depth of the slide 26. The width of the lock latch extension mechanism 40 preferably is less than or equal to the depth of the slide 26, so that the mechanism does not block access to the interior of the cabinet assembly 10. The height of the lock latch extension mechanism 40 is selected so that, as shown in FIG. 3, when the lock bar 22 and lock catch 30 are raised to the unlocked or release position, the shuttle slide 44 is provided with a clearance sufficient for slidably moving between the locking position and the release position.

Referring now to FIGS. 4(*a*) to 4(*j*), general operation sequences of the lock latch extension mechanism 40 are illustrated. FIGS. 4(*a*) to 4(*d*) illustrate an opening sequence, and FIGS. 4(*e*) to 4(*g*) and 4(*a*) illustrate a closing sequence. FIG. 4(*h*) to 4(*j*) and 4(*a*) illustrate an alternative closing sequence.

In FIG. 4(*a*), the lock catch 30 is in the default/locked position (vertically lowered), the shuttle slide 44 is in the locking position (shifted to the left relative to the shuttle retainer, as viewed in the drawings), and the striker bail 36 is captured by the striker detent 60 of the shuttle slide 44. In this configuration, the cabinet door 14 is both latched and locked shut.

In FIG. 4(*b*), the lock catch 30 is raised to the unlocked position by movement of the lock bar 22 in the vertical direction, as shown by the arrow B. In this configuration, the striker bail 36 remains captured by the striker detent 60 of the shuttle slide 44, and the shuttle slide 44 is free to slide within the shuttle retainer. However, as discussed in greater detail below, the shuttle slide is biased to remain in the locking position unless and until an opening force is applied to the shuttle slide 44 by the striker bail 36. Thus, the cabinet door 14 is latched, but not locked shut.

In FIG. 4(*c*), an opening force is applied to the cabinet door 14, as shown by the arrow C1. This force is transferred to the shuttle slide 44 via the striker bail 36, and the shuttle slide 44 is moved in a direction away from the locking position toward the release position (toward the right as viewed in the drawing). As the striker bail 36 and shuttle slide 44 move toward the release position, the striker bail 36 impinges on the proximal side of the static ramp 48 of the shuttle retainer 42 and is cammed upward by the static ramp 48, as shown by the arrow C2. In this manner, since the shuttle slide 44 is free sliding, the striker bail 36 also will ride up the face of the striker detent 60 of the shuttle slide 44 until the striker bail 36 reaches the apex of the static ramp 48 (the release position). It will be appreciated that, as the striker bail 36 is cammed up the static ramp 48, the striker bail 36 is levered upward, thereby generating a spring bias force in the direction of the arrow C3. This spring bias force C3 biases the striker bail to cam back down the proximal side of the static ramp 48. This spring bias force C3 thus may be utilized as a threshold force for biasing the cabinet door 14 to remain latched, in a substantially closed position, until an opening force C1 sufficient to overcome the threshold spring bias force C3 is applied to the cabinet door 14.

In FIG. 4(*d*), the shuttle slide 44 is in the release position. In this configuration, fasteners 66 engage the stop portion (proximal ends) of the elongated slots 70 and restrain the shuttle side 44 from moving further to the right as shown in the drawing. Thus, as the opening force continues to be applied, as shown by the arrow D1, the striker bail 36 first is cammed up to the step height and onto the step portion 58 of the latching portion 52 of the shuttle slide 44, and then is pulled clear of the latching portion 52 of the shuttle slide 44. In this manner, the cabinet door 14 is both unlocked and unlatched.

In this regard, it also will be appreciated that, as the striker bail 36 is pulled clear of the latching portion 52 of the shuttle slide 44, the striker bail 36 will recoil due to the spring bias force generated in the direction of the arrow D2. As the striker bail 36 recoils, the striker bail 44 will ramp down the ramp portion 56 of the latching portion 52 of the shuttle slide 44. In this manner, the striker bail 36 will impart a small closing force on the shuttle slide 44, which thus will be biased to move back in a direction from the release position toward the locking position.

In FIG. 4(*e*), the lock latch is in the open or raised position (the lock bar 22 and the lock catch 30 are vertically raised), and the shuttle slide 44 is in the release position (shifted to the right relative to the shuttle retainer 42, as viewed in the drawings). A closing force is applied to the cabinet door 14, as shown by the arrow E1. The closing force E1 is transferred to the shuttle slide 44 via the striker bail 36. Since the shuttle slide 44 is unlocked and unlatched, it is free sliding and moves in a direction from the release position toward the locking position, indicated by the arrow E2.

In FIG. 4(*f*), the shuttle slide 44 reaches the locking position. In this configuration, the fasteners 66 engage the stop portions (distal ends) of the elongated slots 70 and restrain the shuttle slide 44 from moving further to the left as shown in the drawings. As the closing force is continued, as shown by the arrow F1, the striker bail 36 impinges either (or both) the ramp portion 56 of the shuttle slide 44 or the static ramp 48, and is cammed upward until it reaches the step height, e.g., the apex of the static ramp 48. Thus, the camming function may be provided by the ramp portion 56 alone, and the distal face of the static ramp 48 need not be provided. When the striker bail 36 reaches the step height, the striker bail 36 rides up onto the step portion 58 of the latching portion 52 of the shuttle slide 44. As the closing force continues, the striker bail 36 traverses the length of the stop portion 58 until it reaches the striker detent 60.

In FIG. 4(*g*), the shuttle slide 44 is in the locking position, and the striker bail 36 drops into the striker detent 60 of the shuttle slide 44. The lock catch 30 remains in the unlocked (raised) position. In this configuration, the shuttle slide 44 remains free sliding, and the cabinet door 14 is again latched, but not locked.

Also, as previously noted, in this configuration, although the shuttle slide 44 is free sliding, any movement of the striker bail 36 in a direction toward the release position will cam the striker bail 36 up the proximal side of static ramp 48 and thereby generate a spring bias force tending to move the striker bail 36 back in a direction toward the locking position. Accordingly, the cabinet door 14 is biased to remain in the latched (but not locked) state until another opening force is applied to the cabinet door (see FIG. 4C), or the lock bar 22 and lock catch 30 are vertically lowered to the locked position (see FIG. 4(*a*)).

In FIG. 4(*h*), the shuttle slide 44 is in the release position, the lock catch 30 is in the default/locked position, and the cabinet door 14 is open. As a closing force is applied to the cabinet door 14, shown by the arrow H1, the striker bail 36 strikes the ramp portion 56 and imparts a closing force to the shuttle slide 44, shown by the arrow H2. Since the shuttle slide 44 is free sliding, it initially will slide in a direction toward the locking position, until the detent ramp 62 of the locking portion 54 impinges on a lock catch ramp 72 of the lock catch 30. As the cabinet door 14 continues to close, the striker bail 36 will cam up the ramp portion 56 to the step portion 58 of the latching portion 52 of the shuttle slide 44.

In FIG. 4(*i*), as the cabinet door 14 is further closed, as indicated by the arrow I1, the striker bail 36 will ride down the proximal side of the static ramp 48 to the cut away portion 50 of the shuttle retainer 42, and the striker bail assembly 34 of the cabinet door 14 will strike the distal end of the shuttle slide 44. In this configuration, any movement by the cabinet door 14 in an opening direction will generate a spring bias force in the direction of the arrow I2, tending to close the cabinet door 14. Thus, in this configuration, the cabinet door 14 is latched (but not locked) with a threshold spring bias force tending to close the cabinet door 14.

In FIG. 4(*j*), as the cabinet door 14 is further closed, as shown by the arrow J1, the striker bail assembly 34 of the cabinet door 14 transmits the closing force to the shuttle slide 44, as indicated by the arrow J2, and the shuttle slide 44 moves in a direction toward the locking position, as indicated by the arrow J3. As the shuttle slide 44 moves, the lock catch 30 is levered up by a camming action between the lock catch ramp 72 and the detent ramp 62, and a spring bias force is generated in the lock catch 30 in the direction of the arrow J4, tending to return the lock catch 30 to the default/locked position. Accordingly, when the locking portion 54 of the shuttle slide 44 passes under the lock catch 30 by camming action, the lock catch 30 will drop into the cut away portion 50 of the shuttle retainer 42 and engage the lock detent 64 of the shuttle slide 44 (see FIG. 4(*a*)).

The alternative locking operation sequence illustrated in FIGS. 4(*h*) to 4(*j*) may be particularly advantageous in certain applications. For example, in a system which includes a cabinet door 14 that covers less than all of a plurality of storage articles 20, the present configuration permits the user to lock the cabinet door 14 and some of the storage articles 20 (e.g., enclosed shelves) closed, and then later close and lock other storage articles 20 (e.g., non-enclosed drawers inadvertently left open), without reopening (unlocking) the cabinet door 14.

In another aspect, it may be desirable to maintain various drawers, shelves or trays 20 locked in the cabinet assembly 10 while maintaining the cabinet door 14 open to access items in such drawers, shelves or trays 20. The cabinet door 14 then may be latched, but not locked (see FIG. 4(*i*)), e.g., for transporting the cabinet assembly 10 to a different location, and then reopened the cabinet door 14 merely by pulling the cabinet door 14 with an opening force large enough to overcome the threshold spring bias force generated by the camming action between the static ramp 48 and the striker bail 36. Finally, the cabinet door 14 may be latched and locked by closing the cabinet door 14 with a closing force sufficient to overcome both the spring bias force generated by the camming action between the static ramp 48 and the striker bail 36, and the spring bias force generated by the camming action between the lock catch 30 and the lock detent 64 of the shuttle slide 44.

Thus, the present embodiment achieves all of the above-described objects, advantages and desirable features of the present invention.

Figure 5:
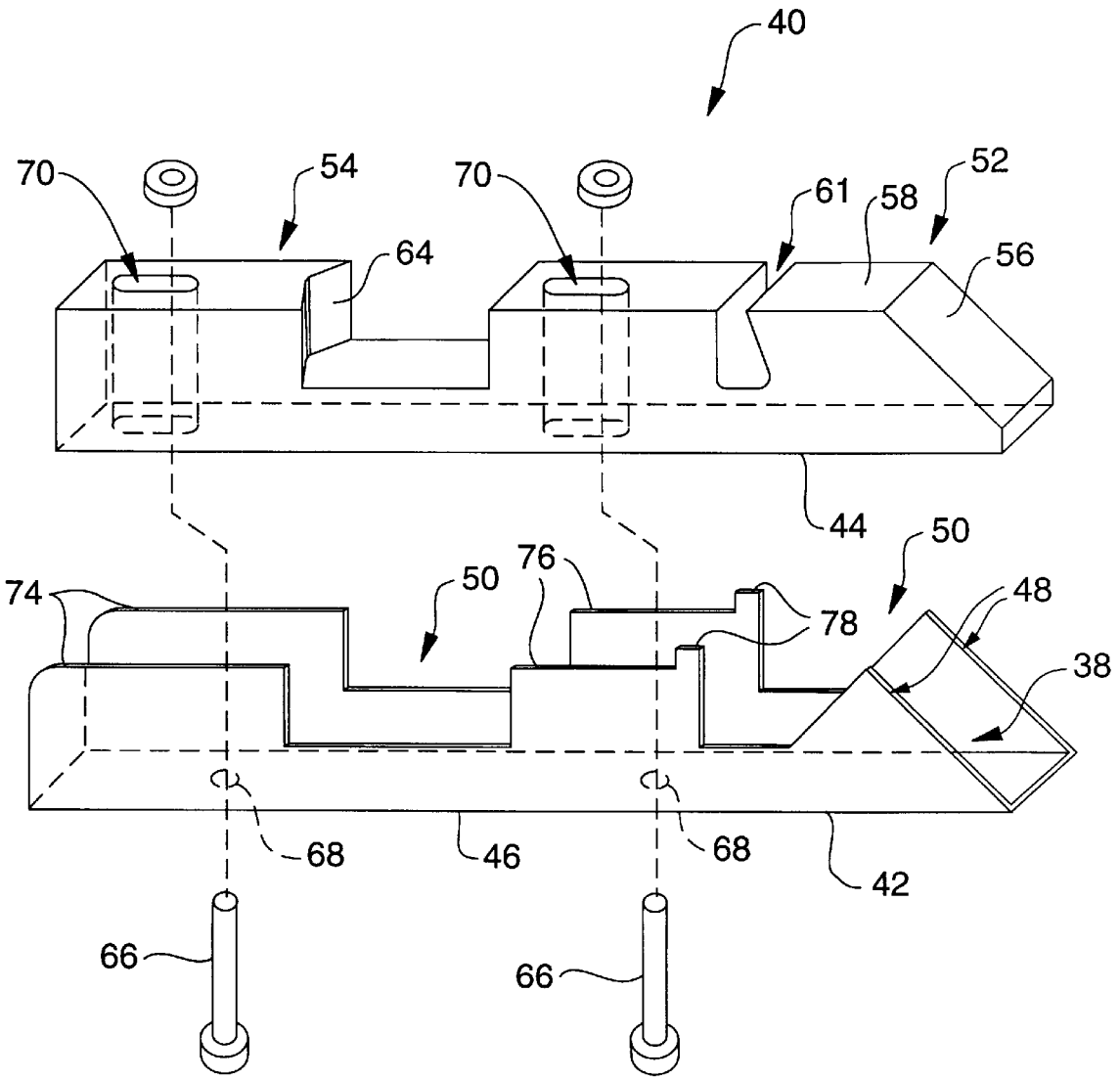
FIG. 5 is an exploded view of a second embodiment of a lock latch extension mechanism of the present invention.
Figure 6A:
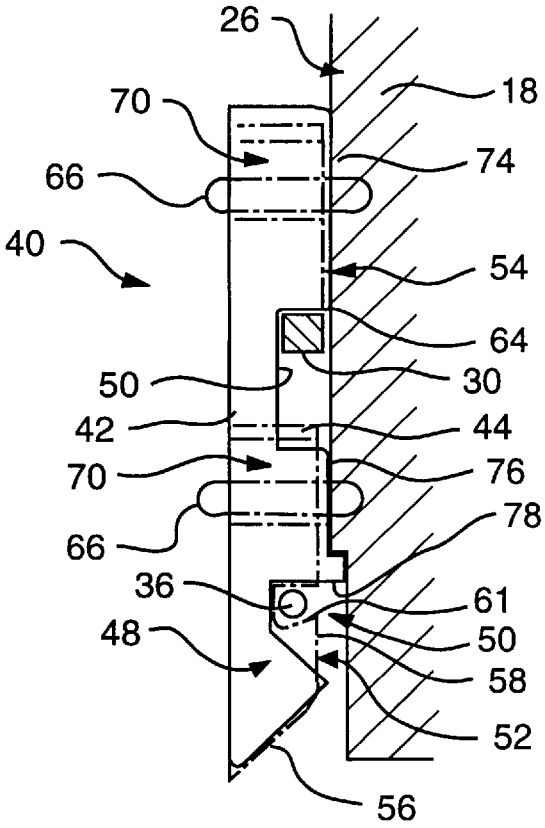
FIGS. 6(*a*) to 6(*d*) illustrate a general operation sequence for a lock assembly including the lock latch extension mechanism illustrated in FIG. 5 wherein FIGS. 6(*a*) to 6(*d*) schematically illustrate in top view an operation sequence for the lock latch extension mechanism of FIG. 5.
Figure 6B:
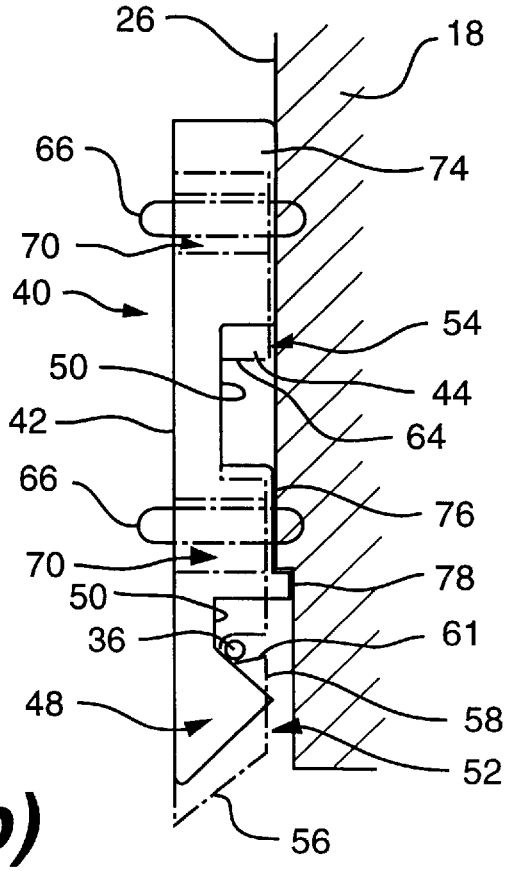
Figure 6C:
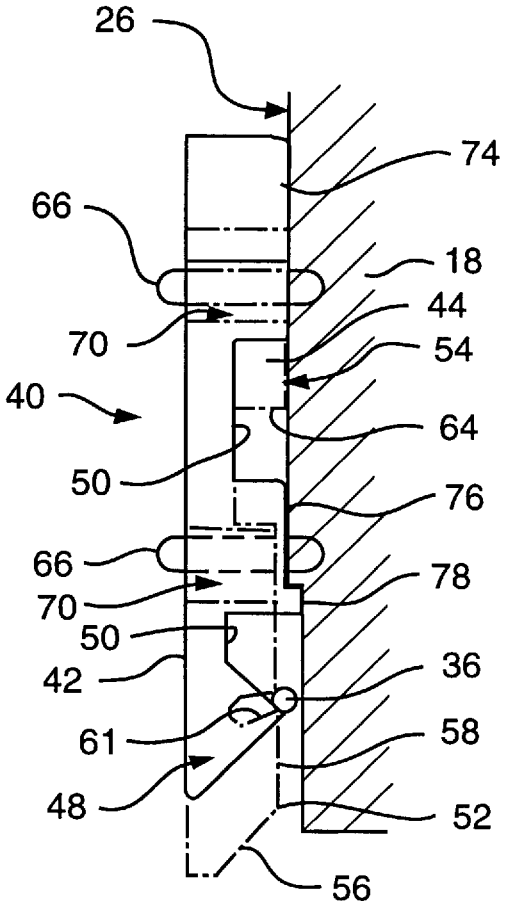
Figure 6D:
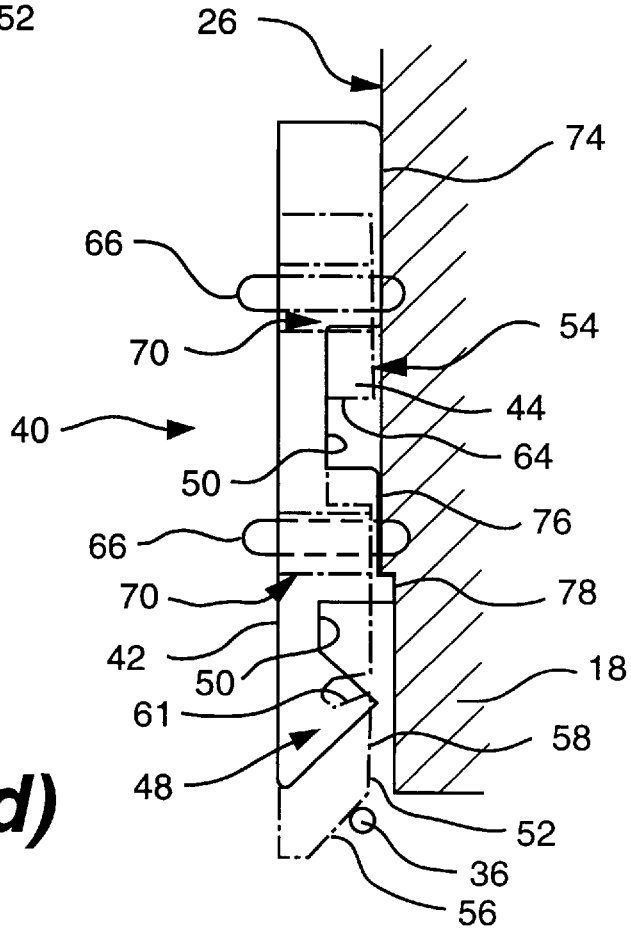

FIG. 5 illustrates in exploded view a second embodiment of a lock latch extension mechanism of the present invention. As in the prior embodiment, the lock latch extension mechanism 40 in FIG. 5 generally comprises a shuttle retainer 42 and shuttle slide 44. The general structures and functions of these elements are substantially the same as in the prior embodiment, although in the embodiment of FIG. 5, the shuttle retainer 42 and shuttle slide 44 are rotated 90 degrees about the longitudinal axis of the lock latch extension mechanism 40 when the lock latch extension mechanism 40 is mounted in the storage system 10. Likewise, the striker bail assembly 34 and the striker bail 36 mounted on the cabinet door 14 of a cabinet assembly 10 incorporating the lock latch extension mechanism 40 of the present invention are rotated 90 degrees when mounted, so that the striker bail 36 has a vertical orientation. Accordingly, the following discussion of the embodiment of FIG. 5 incorporates by reference the discussion of the prior embodiment structures and functions, except as noted in the discussion below.

The shuttle retainer 42 has a generally U-shaped body 46 and includes a static ramp 48 and a cut away portion 50. The shuttle retainer 44 of the present embodiment also includes a pair of rear mounting extensions 74, and a pair of mid mounting extensions 76. The mid mounting extensions 76 further include a pair of locating tabs 78 disposed at a distal end of the mid mounting extensions 76. As discussed in greater detail below, the mounting extensions 74,76 are arranged and sized to provide sufficient clearance in the slide channel 38 of the shuttle retainer 42 for the shuttle slide 44 to slidably move between the locking position and the release position, and to provide sufficient clearance for a lock catch 30 to be vertically lowered to the default/locking position. The pair of locating tabs 78 cooperate with a jog portion in side wall panel 18, to-reliably locate the lock latch extension mechanism 40 relative to the side wall panel 18. The jog provides a clearance between the static ramp 48 and the side wall panel 18, sufficient to allow the striker bail 36 to cam over the static ramp 48 (see FIGS. 6(*a*) to 6(*d*) below).

The shuttle slide 44 includes a latching portion 52 and a locking portion 54. The latching portion 52 includes a ramp portion 56, a step portion 58 and a latch slot 61. The latch slot 61 in the embodiment of FIG. 5 functions substantially the same as the striker detent 60 in the prior embodiment. That is, the latch slot 61 provides means for receiving and capturing a striker bail 36. The locking portion 54 of the present embodiment includes a lock detent 64 for engaging a lock catch 30 to lock the shuttle slide 44 in the locking position.

Similarly to the prior embodiment, the shuttle retainer 42 and shuttle slide 44 in the embodiment of FIG. 5 are mountable in a slide 26 between two adjacent rails 26 of a side wall panel 18 of the cabinet body 12 by conventional fasteners 66. Also as in the prior embodiment, in the embodiment of FIG. 5 the shuttle retainer 42 is provided with fastener holes 68, and the shuttle slide 44 is provided with elongated slots 70 which cooperate with the fasteners 66 to form guide means and restraining means.

FIGS. 6(*a*) to 6(*d*) schematically illustrate in top view an operation sequence for the lock latch extension mechanism 40 of FIG. 5.

In FIG. 6(*a*), the lock catch 30 is in the default/locked position, the shuttle slide 44 is in the locking position, and the striker bail 36 is captured in the latch slot 61 of the latching portion 52 of the shuttle slide 44. In this configuration, the lock catch 30 engages the lock detent 64 of the shuttle slide 44 and locks the shuttle slide 44 in the locking position. Thus, the cabinet door 14 is both latched and locked.

In FIG. 6(*b*), the lock catch 30 is vertically raised to the unlocked position (not shown in FIG. 6(*b*)), and the shuttle slide 44 is free sliding. Thus the cabinet door 14 is latched, but not locked.

In FIG. 6(*c*), the cabinet door 14 is opened, and the opening force is transferred through the striker bail 36 to the shuttle slide 44. The shuttle slide 44 thereby slidably moves in a direction from the locking position to the release position. As in the prior embodiment, in the present embodiment the fasteners 66 cooperate with the elongated slots 70 to stop the shuttle slide 44 at the release position, and the striker bail 36 is cammed up over the proximal side of the static ramp 48 of the shuttle retainer 42 and through a clearance gap between the static ramp 48 and the side wall panel 18 onto the step portion 58 of the shuttle slide 44.

In FIG. 6(*d*), the cabinet door 14 is further opened, and the striker bail 36 is pulled free of the latching portion 52 of the shuttle slide 44. Also, a spring bias force generated in the striker bail 36 by the camming action of the striker bail 36 over the static ramp 48, causes the striker bail 36 to ramp down the ramp portion 56 of the shuttle slide 44, thereby biasing the shuttle slide 44 to slidably move in a direction from the release position toward the locking position.

The closing operation sequence for the present embodiment is substantially the same as in the prior embodiment. An alternative closing operation sequence in which the lock catch 30 is vertically lowered to the default/locked position prior to closing the cabinet door 14 also is substantially the same.

Thus, the lock latch extension mechanism 40 of the embodiment of FIGS. 5 and 6(*a*) to 6(*d*) also achieves all of the above-described objects, advantages and desirable features of the present invention.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A lock latch extension mechanism for a lock assembly including a lock catch and a striker member, said lock latch extension mechanism comprising:

a linear shuttle slide including a locking portion engagable with the lock catch of the lock assembly, and a latching portion engagable with the striker member of the lock assembly.

2. A lock latch extension mechanism as recited in claim 1, further comprising:

a shuttle retainer for slidably supporting said shuttle slide.

3. A lock latch extension mechanism as recited in claim 1, wherein said latching portion is remote from said locking portion.

4. A lock latch extension mechanism as recited in claim 1, wherein said shuttle slide is movable between a locking position, where the lock catch of the lock assembly is engagable with the locking portion, and a release position, where the lock catch is not engagable with the locking portion.

5. A lock latch extension mechanism as recited in claim 4, wherein the striker member is engagable with the latching portion when the shuttle slide is in the locking position and the release position, and releasable from the latching portion when the shuttle slide is in the release position.

6. A lock latch extension mechanism as recited in claim 4, wherein a striker member engaged and captured by said latching portion is releasably engaged with the latching portion when the latching portion is in the release position.

7. A lock latch extension mechanism for a lock assembly including a lock catch and a striker member, said lock latch extension mechanism comprising:

a shuttle retainer including a slide channel formed therein, said shuttle retainer including in side profile a static ramp located at a distal end thereof, for camming a striker member incident thereon to a step height, and a central cut away portion for receiving a lock catch; and a shuttle slide slidably supported in the slide channel of said shuttle retainer between a locking position and a release position, said shuttle slide including a locking portion and a latching portion, said latching portion being located at a distal end thereof and including a ramp portion, a step portion, and latching means for releasably capturing a striker member, said ramp portion extending from a distal end of the shuttle slide to the step portion of said latching portion, said latching means being located on a proximal side of the step portion relative to the ramp portion, such that, when said shuttle slide is in the locking position, the latching means is located on a proximal side of the static ramp of said shuttle retainer in an open configuration for capturing a striker member, and a detent of the locking portion of said shuttle slide cooperates with the cut away portion of said shuttle retainer for capturing the lock catch, and when said shuttle slide is in the release position, the latching means cooperates with the static ramp of said shuttle retainer to release the striker member.

8. A lock latch extension mechanism as recited claim 7, wherein said shuttle retainer includes at least one slide restraint.

9. A lock latch extension mechanism as recited in claim 8, wherein said at least one slide restraint comprises at least one fastener for mounting said shuttle retainer.

10. A lock latch extension mechanism as recited in claim 8, wherein the number of slide restraints is two.

11. A lock latch extension mechanism as recited in claim 9, wherein the number of slide restraints is two.

12. A lock latch extension mechanism as recited in claim 8, wherein said shuttle slide includes at least one guide portion extending in a direction of movement of said shuttle slide and receiving said at least one slide restraint, each said at least one guide portion including at least one stop portion engagable with said at least one slide restraint to limit a sliding movement of said shuttle slide at the locking position and the release position.

13. A lock latch extension mechanism as recited in claim 12, wherein said at least one guide portion comprises at least one elongated slot extending in a direction of sliding movement of said shuttle slide.

14. A lock latch extension mechanism as recited in claim 12, wherein said at least one slide restraint comprises at least one fastener for mounting said shuttle retainer, said at least one guide portion comprises at least one elongated slot extending in a direction of sliding movement of said shuttle slide, each of said at least one guide portion receiving a respective one of said at least one fastener.

15. A lock latch extension mechanism as recited in claim 14, wherein the number of elongated slots and fasteners is two.

16. A lock latch extension mechanism as recited in claims 7, wherein said shuttle retainer includes first and second side panels forming the slide channel therebetween, said first and second side panels forming in side profile the static ramp located at a distal end thereof for camming a striker bail incident thereon to a step height, and the central cut away portion for receiving the lock catch.

17. A lock latch extension mechanism as recited in claim 7, wherein said latching means includes a striker detent for releasably capturing the striker member.

18. A lock latch extension mechanism as recited in claim 7, wherein said static ramp has a triangular profile.

19. A lock latch extension mechanism as recited in claim 18, wherein the ramp portion of said shuttle slide has a profile complementary to the profile of the static ramp of said shuttle retainer.

20. A latch extension mechanism as recited in claim 7, wherein said static ramp comprises a ramp surface on a proximal side thereof, and said static ramp and the ramp portion of said shuttle slide are complimentary in profile.

21. A lock latch extension mechanism as recited in claim 7, wherein said latching means comprises a striker detent.

22. A lock latch extension mechanism as recited in claim 7, wherein said latching means comprises a latch slot.

23. A lock latch extension mechanism for a lock assembly including a lock catch and a striker member, the lock latch extension mechanism comprising:

a shuttle slide movable between a locking position and a release position and including locking means, cooperable with the lock catch, for releasably locking the shuttle slide in the locking position, and latching means for releasably capturing the striker member; and a shuttle retainer slidably supporting said shuttle slide for sliding movement between the locking position and the release position, and including static ramp means for camming a striker member incident thereon to a step height, said static ramp means being cooperable with the latching means of said shuttle slide to selectively capture or release the striker member in the latching means of said shuttle slide.

* * * * *

UNITED STATES PATENT AND TRADEMARK OFFICE

CERTIFICATE OF CORRECTION

PATENT NO. : 5,802,892

DATED : September 8, 1998

INVENTOR(S) : ROBERT J. COHN

It is certified that error appears in the above-identified patent and that said Letters Patent is hereby corrected as shown below:

Column 6

Line 3, "bail." should read --bail--.

Line 36, "system-also" should read --system also--.

Column 11

Line 20, "to-reliably" should read --to reliably--.

Signed and Sealed this

Eighteenth Day of May, 1999

*Attest:*

*Attesting Officer*

Q. TODD DICKINSON

*Acting Commissioner of Patents and Trademarks*